US006508081B1

(12) United States Patent
Simpson

(10) Patent No.: US 6,508,081 B1
(45) Date of Patent: Jan. 21, 2003

(54) EARRING WITH INTERCHANGEABLE ORNAMENTS

(75) Inventor: Yosef Simpson, Brooklyn, NY (US)

(73) Assignee: Chester Industries, Inc., New York, NY (US)

( * ) Notice: Subject to any disclaimer, the term of this patent is extended or adjusted under 35 U.S.C. 154(b) by 6 days.

(21) Appl. No.: 09/689,230

(22) Filed: Oct. 12, 2000

(51) Int. Cl.[7] ..... A44C 7/00
(52) U.S. Cl. ..... 63/12; 63/13
(58) Field of Search ..... 63/12, 13

(56) References Cited

U.S. PATENT DOCUMENTS 387,449 A * 8/1888 Ripley ..... 63/27
758,848 A * 5/1904 Pejchar ..... 63/12
3,418,826 A * 12/1968 Wieshuber ..... 63/13
3,446,033 A * 5/1969 Driscoll ..... 63/12
4,221,118 A * 9/1980 Chicckine ..... 63/13
D264,060 S * 4/1982 Epstein ..... D11/40
D265,894 S * 8/1982 Barr ..... D11/43
5,077,987 A * 1/1992 Leith, III ..... 63/13
5,577,396 A * 11/1996 Cannon ..... 63/13
5,638,700 A * 6/1997 Shechter ..... 63/12
6,058,737 A * 5/2000 Domagala ..... 63/12

* cited by examiner

*Primary Examiner*—Robert J. Sandy
*Assistant Examiner*—Andrea Chop
(74) *Attorney, Agent, or Firm*—Joseph E. Levi, Esq.; Zimmerman & Levi, LLP

(57) ABSTRACT

An earring is provided and includes a basket including a circular member having a center. Also included is a curved member having a first end and a second end wherein the first end of the curved member is connected to the circular member. A post is included and has a first end and a second end. The first end of the post is affixed to a wearer's ear lobe and the second end of the post is connected to the second end of the curved member. The curved member is dimensioned and shaped so that the post is axially aligned with the center of the circular member. An ornament having a loop member is dimensioned and shaped to slideably receive the post and the curved member. When the post is inserted through the loop member, the ornament is suspended from the curved member adjacent said circular member.

6 Claims, 2 Drawing Sheets

EARRING WITH INTERCHANGEABLE ORNAMENTS

BACKGROUND

The following invention relates to an earring and, in particular, to an earring that supports selectively interchangeable ornaments.

Jewelry is typically selected by a wearer according to a particular mood, fashion choice and occasion. Because jewelry is often costly, however, the wearer may only have a limited number of jewelry items from which to choose. Accordingly, it is desirable to provide a single jewelry item that can be easily adapted by the wearer to be suitable for different situations.

With respect to earrings, prior art designs exist for selectively adapting an earring by attaching different ornaments to the earring. For example, U.S. Pat. No. 4,803,852, issued to Waldron, discloses an earring comprising a loop member that is attachable to an ear. The loop member has a narrow throat that allows a link of a charm to be pulled therethrough to attach the charm to the earring. In this way, the wearer can selectively attach a particular charm to the earring as desired.

Although Waldron allows the wearer to attach different charms to the earring as desired, Waldron, however, requires the use of an earring that contains a loop for receiving the charm. This limitation precludes the use of Waldron with earring designs that do not include a loop.

Another prior art earring design that supports interchangeable ornaments is disclosed in U.S. Pat. No. 5,505,061 issued to Fleury. Fleury teaches a jewelry apparatus, such as an earring, that includes a body portion having an ornamental outer surface and an engagement surface, and further includes an ornament portion having an ornamental outer surface and an engagement surface. The engagement surface of the body portion includes a cylindrical recess and a bore which extends axially inwardly from the center of the cylindrical recess. The engagement surface of the ornament portion includes a cylindrical neck and a post which extends axially outwardly therefrom. The cylindrical neck and post of the ornament portion are slideably received in frictional, interfitting engagement into the complimentary recess and bore of the body portion. When the body portion and ornament portion are received in engagement, the ornamental surface thereof cooperatively merge so that the body portion and the ornament portion appear as an integral unit.

Although the mechanism taught in Fleury is not limited to earrings designs that contain a loop, Fleury does requires that the earring body include a cylindrical recess and a bore for receiving the ornament which is not feasible for a variety of earring designs, such as stud earrings. Furthermore, because Fleury requires that the ornament be specially designed to have a cylindrical neck and post to mate with the earring body, existing ornaments that a wearer may have for use with a bracelet or necklace are not suitable for use with the earring of Fleury.

Referring now to FIG. 1, there is shown a prior art stud earring 2. Stud earring 2 includes a stone 4, such as a diamond, that is held by a basket 6. Basket 6 typically includes a pair of parallel circular members 8,8' and a plurality of prongs 10 that are fastened to both of circular members 8,8' in a perpendicular orientation. Stone 4 is inserted into basket 6 and supported by circular member 8. The top of each of prongs 10 is curved for gripping stone 4 and securing stone 4 in basket 6. Attached across the diameter of circular member 8' is a radial member 12. A post 14 is perpendicularly attached to radial member 12 at a first end and is dimensioned and shaped at a second end for attaching to a wearer's ear.

Referring now to FIG. 2, there is shown an ornament 16 that is selectively attached to stud earring 2. Ornament 16 includes a decorative portion 18 and a loop member 20 connected to ornament 16. Loop member 20 is dimensioned and shaped so as to be slideably received on post 14. Thus, when the wearer desires to attach an ornament to earring 2, the wearer inserts post 14 into loop member 20 and slides ornament 16 until it is adjacent to circular member 8'. If the wearer desires to have a different ornament attached to earring 2, the wearer slides ornament 16 off post 14 and slides the different ornament on post 14 instead. In this way, earring 2 of the prior can be used to selectively attach ornaments.

There are significant drawbacks, however, in attaching ornament 16 to earring 2 of the prior art in the manner described above. First, because post 14 terminates at the center of circular member 8', when ornament 16 is positioned on post 14 via loop member 20, a portion of decorative portion 18 may be obscured by basket 6. In addition, because ornament 16 can only be slid on post 14 until it contacts circular member 8' of basket 6, ornament 16 is not coplanar with stone 4 thereby diminishing the appearance of the earring-ornament combination. Furthermore, because ornament 16 may contact the wearer's ear when post 14 is affixed to the wearer's ear, attaching ornament 16 to earring 2 in this manner may cause the wearer discomfort.

Accordingly, it is desirable to provide an earring that allows the wearer to selectively interchange ornaments while overcoming the drawbacks of the prior art.

SUMMARY OF THE INVENTION

The present invention overcomes the drawbacks of the prior art. According to the present invention, an earring is provided and includes a basket for holding a decorative item wherein the basket includes a circular member having a center. Also included is a curved member having a first end and a second end wherein the first end of the curved member is connected to the circular member. A post is included and has a first end and a second end. The first end of the post is affixed to a wearer's ear and the second end of the post is connected to the second end of the curved member. The curved member is dimensioned and shaped so that the post is axially aligned with the center of the circular member. An ornament having a loop member is dimensioned to slideably receive the post and the curved member. When the post is inserted through the loop member, the ornament is suspended from the curved member adjacent the circular member and is coplanar with the decorative item contained in the basket.

The invention accordingly comprises the features of construction, combination of elements and arrangement of parts that will be exemplified in the following detailed disclosure, and the scope of the invention will be indicated in the claims. Other features and advantages of the invention will be apparent from the description, the drawings and the claims.

DESCRIPTION OF THE DRAWINGS

For a fuller understanding of the invention, reference is made to the following description taken in conjunction with the accompanying drawings, in which.

DETAILED DESCRIPTION OF THE PREFERRED EMBODIMENTS

Figure 1:
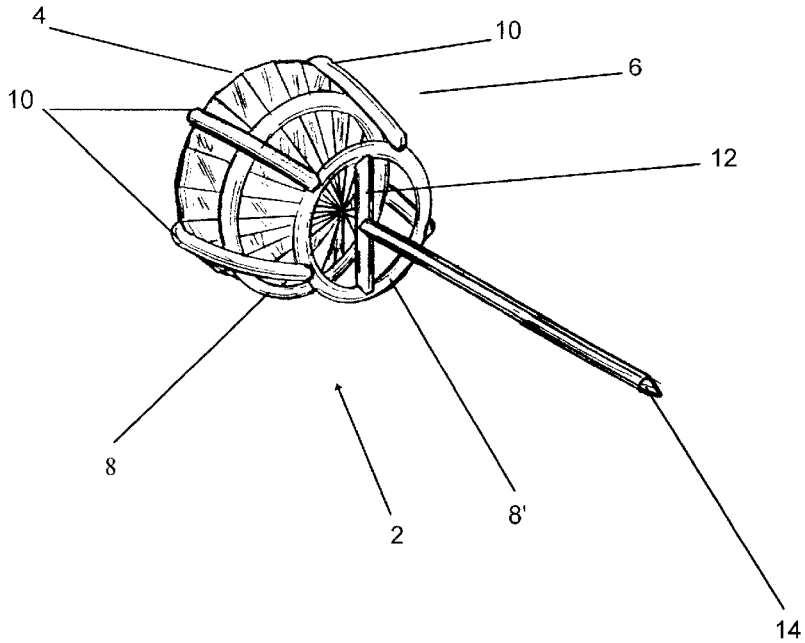
FIG. 1 PRIOR ART
FIG. 1 is a perspective view of a prior art stud earring.
Figure 2:
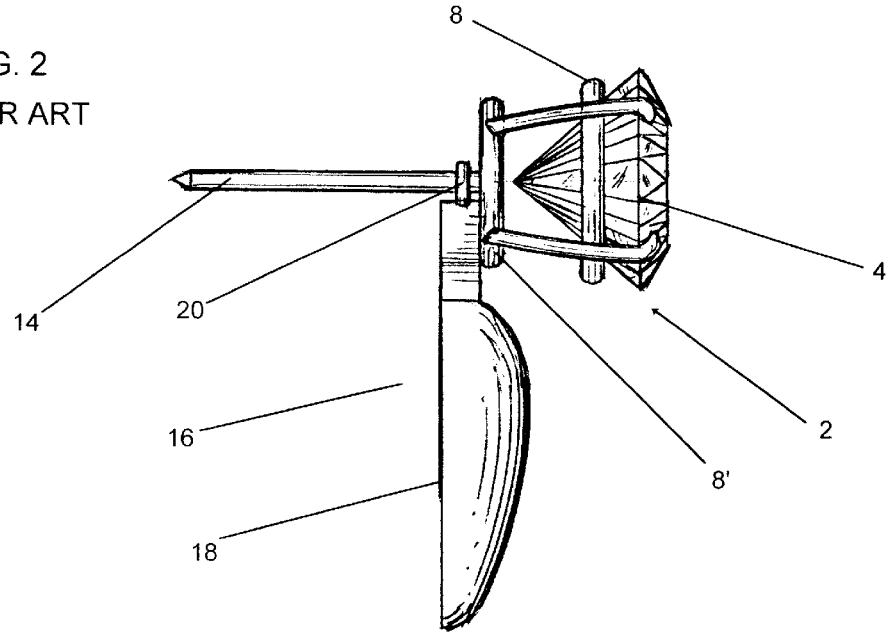
FIG. 2 PRIOR ART
FIG. 2 is a side view of an ornament attached to stud earring of FIG. 1.
Figure 3:
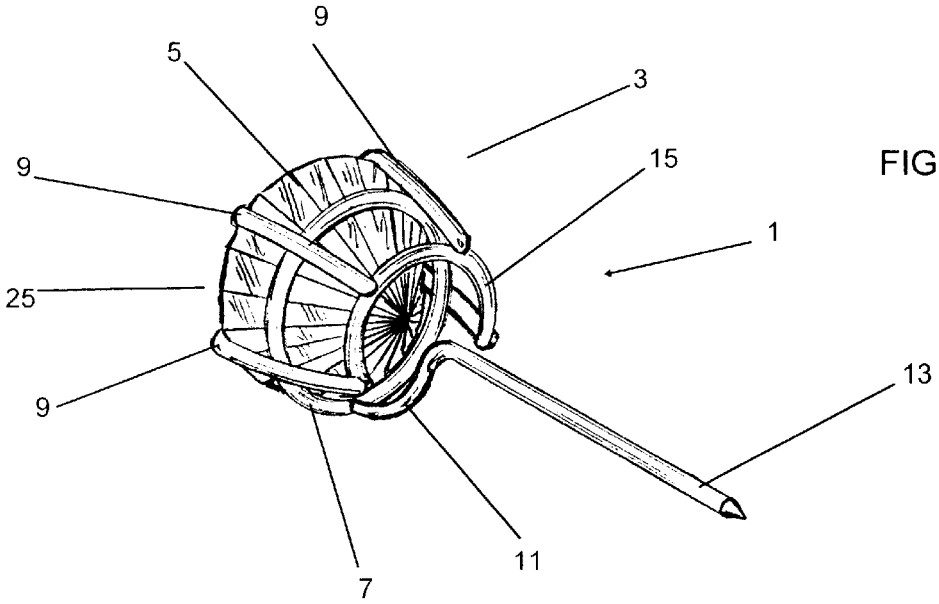
FIG. 3, is a perspective view of the earring in accordance with the present invention.

Referring now to FIG. 3, there is shown an earring 1 of the present invention. Earring 1 includes a basket 3 that is used to contain a decorative item 5, such as a stone, having a front face 25. Alternatively, decorative item 5 may be integrally formed with basket 3. Basket 3 includes a circular member 7 and a plurality of prongs 9 that are fastened to circular member 7 in a perpendicular orientation. Prongs 9 are dimensioned and shaped so as to grip decorative item 5 and secure decorative item 5 in basket 3. A curved member 11 is included and has a first end and a second end wherein the first end is connected to circular member 7. A post 13 is included and has a first end and a second end wherein the first end is dimensioned and shaped for affixing earring 1 to a wearer's ears. The second end of post 13 is connected to the second end of curved member 11. The curved member is dimensioned and shaped so that when post 13 is connected to curved member 11, post 13 is axially aligned with the center of circular member 7.

In an exemplary embodiment, basket 3 includes a semi-circular member 15 that has an open portion 17. Semi-circular member 15 is connected to plurality of prongs 9 and is positioned in basket 3 parallel to circular member 7, adjacent to the second end of post 13 and so that curved member 11 is adjacent open portion 7 of semi-circular member 15. When earring 1 is affixed to the wearer's ear, the wearer's ear contacts semi-circular member 15.

Figure 4:
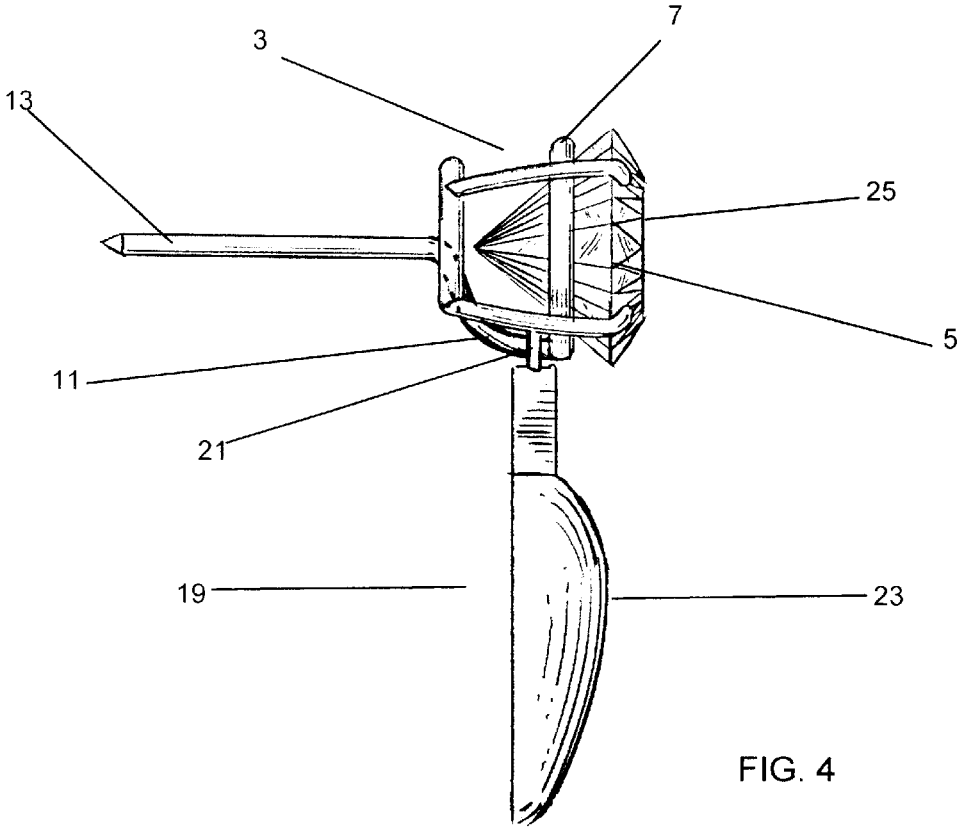
FIG. 4 is a side cross-sectional view of an ornament attached to the earring of FIG. 3.

Referring now to FIG. 4, there is shown an ornament 19 attached to earring 1 of the present invention. Elements that are identical to elements in FIG. 3 are similarly labeled and a detail description thereof is eliminated.

Ornament 19 includes a loop member 21 and a decorative portion 23. In a preferred embodiment, decorative portion 23 is selected so as to be coordinated with decorate item 5. Loop member 21 is dimensioned and shaped so that post 13 and curved member 11 are slideably received in loop member 21. When post 13 is inserted through loop member 21, ornament 19 is received by curved member 11 and ornament 19 is suspended by curved member 11 at a point that is adjacent to circular member 7 and adjacent to the lower-front portion of basket 3. In an exemplary embodiment, curved member 11 may be of any shape, such as by way of non-limiting example, curved or angular, that holds ornament 19 adjacent to the lower-front portion of basket 3 and adjacent circular member 7.

Because ornament 19 is suspended by curved member 11 at a point that is adjacent to circular member 7 and that is beyond semi-circular member 15, ornament 19 does not contact the wearer's ear thereby eliminating any discomfort resulting from ornament 19 pressing against the wearer's ear. Also, because ornament 19 is suspended from curved member 11 adjacent the lower portion of basket 3, ornament 19 is not obscured by basket 3 or decorative item 5. Furthermore, because ornament 19 is suspended from curved member 11 at the front portion of basket 3, ornament 19 is suspended in a manner so as to be substantially coplanar with front face 25 of decorative item 5. In this way, the appearance of decorative item 5 and ornament 19 is enhanced.

Although the description above related to a stud earring having basket 3 holding decorative item 5, the present invention may be applied to a wide range of earring designs by simply affixing to the decorative portion of the earring a curved member and a post in the manner described above so that the attached ornament is suspended from the curved member at a point adjacent the lower-front portion of the decorative item.

Accordingly, an earring is provided that allows the wearer to selectively interchange ornaments and that improves the visual appearance of the earring and ornament while reducing the wearer's discomfort. In addition, any suitable ornament may be attached to earring 1 as long as the ornament has a loop member that can slideably receive post 13 and curved member 11. Thus, ornaments that a wearer uses with necklaces or bracelets may also be used with earring 1.

A number of embodiments of the present invention have been described. Nevertheless, it will be understood that various modifications may be made without departing from the spirit and scope of the invention. Accordingly, other embodiments are within the scope of the following claims. Because certain changes may be made in the construction set forth above without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. An earring, comprising:

a basket, said basket including a circular member having a center;

a curved member having a first end and a second end, said first end of said curved member being connected to said circular member;

a post having a first end and a second end, said first end of said post being dimensioned and shaped for affixing to a wearer's ear, said second end of said post being connected to said second end of said curved member, said curved member being dimensioned and shaped so that said post is axially aligned with said center of said circular member; and an ornament having a loop member, said loop member dimensioned and shaped to slideably receive said post and said curved member so that when said post is inserted through said loop member, said ornament is suspended from said curved member adjacent said circular member;

wherein said basket contains a decorative item having a front face so that when said ornament is suspended from said curved member adjacent said circular member, said front face of said decorative item and said ornament are substantially coplanar.

2. The earring of claim 1, wherein said decorative item is a stone, said circular member has a plane and said basket includes a plurality of prongs attached perpendicularly to said plane of said circular member, said plurality of prongs being dimensioned and shaped so as to secure said stone in said basket.

3. The earring of claim 2, wherein said basket further includes a semi-circular member having an open portion and being connected to said plurality of prongs, said semi-circular member being positioned parallel to said circular member, adjacent said second end of said post and so that said curved member is adjacent said open portion of said semi-circular member, wherein when said post is affixed to the wearer's ear, the wearer's ear contacts said semicircular member.

4. The earring of claim 1, wherein said ornament includes a decorative portion and said decorative item and said decorative portion are selectively coordinated.

5. An earring, comprising:

a decorative item having a center;

a curved member having a first end and a second end, said first end of said curved member being connected to said decorative item; and a post having a first end and a second end, said first end of said post being dimensioned and shaped for affixing to a wearer's ear, said second end of said post being connected to said second end of said curved member, said curved member being dimensioned and shaped so that said post is axially aligned with said center of said decorative item;

wherein said decorative item has a lower-front portion and a front face, and further comprising an ornament having a loop member, said loop member dimensioned and shaped to slideably receive said post and said curved member so that when said post is inserted through said loop member, said ornament is suspended from said curved member adjacent said lower-front portion of said decorative item and said ornament is substantially coplanar with said front face of said decorative item.

6. The earring of claim 5, wherein said ornament includes a decorative portion and said decorative item and said decorative portion are selectively coordinated.

* * * * *